US007948188B2

(12) United States Patent
You et al.

(10) Patent No.: US 7,948,188 B2
(45) Date of Patent: May 24, 2011

(54) LIGHT EMITTING DIODE ILLUMINATING APPARATUS WITH ADJUSTABLE LUMINANCE

(75) Inventors: De-Sheng You, Shenzhen (CN); Ren-Zhong Wei, Shenzhen (CN); Hai-Liang Wang, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 367 days.

(21) Appl. No.: 12/246,556

(22) Filed: Oct. 7, 2008

(65) Prior Publication Data

US 2009/0315483 A1 Dec. 24, 2009

(30) Foreign Application Priority Data

Jun. 18, 2008 (CN) ..... 2008 1 0302178

(51) Int. Cl.
*H05B 41/16* (2006.01)

(52) U.S. Cl. ..... 315/247; 315/185 S; 315/291; 315/209 R; 315/312

(58) Field of Classification Search ..... 315/312–326, 315/291, 247, 246, 185 S, 209 R, 224, 274–279
See application file for complete search history.

(56) References Cited

U.S. PATENT DOCUMENTS

| | | | | |
|---|---|---|---|---|
| 5,381,078 | A * | 1/1995 | Szuba | 315/316 |
| 6,388,399 | B1 * | 5/2002 | Eckel et al. | 315/312 |
| 7,211,958 | B2 * | 5/2007 | Maurer et al. | 315/123 |
| 7,573,210 | B2 * | 8/2009 | Ashdown et al. | 315/307 |

* cited by examiner

*Primary Examiner* — Tuyet Thi Vo
(74) *Attorney, Agent, or Firm* — Steven M. Reiss

(57) ABSTRACT

A light emitting diode (LED) illuminating apparatus (100) includes a controller (20) and an illuminating member (10). The controller is configured for setting a luminance of the LED illuminating apparatus and creating a luminance level value according to the luminance. The illuminating member includes a processor (13), a regulating circuit (15) and an LED lamp (17), the processor is connected to the controller to store the value, the regulating circuit is connected to the processor to receive signals transformed from the value and form output currents sent to the LED lamp according to the signals, thus the LED lamp emits light has the predetermined luminance.

7 Claims, 1 Drawing Sheet

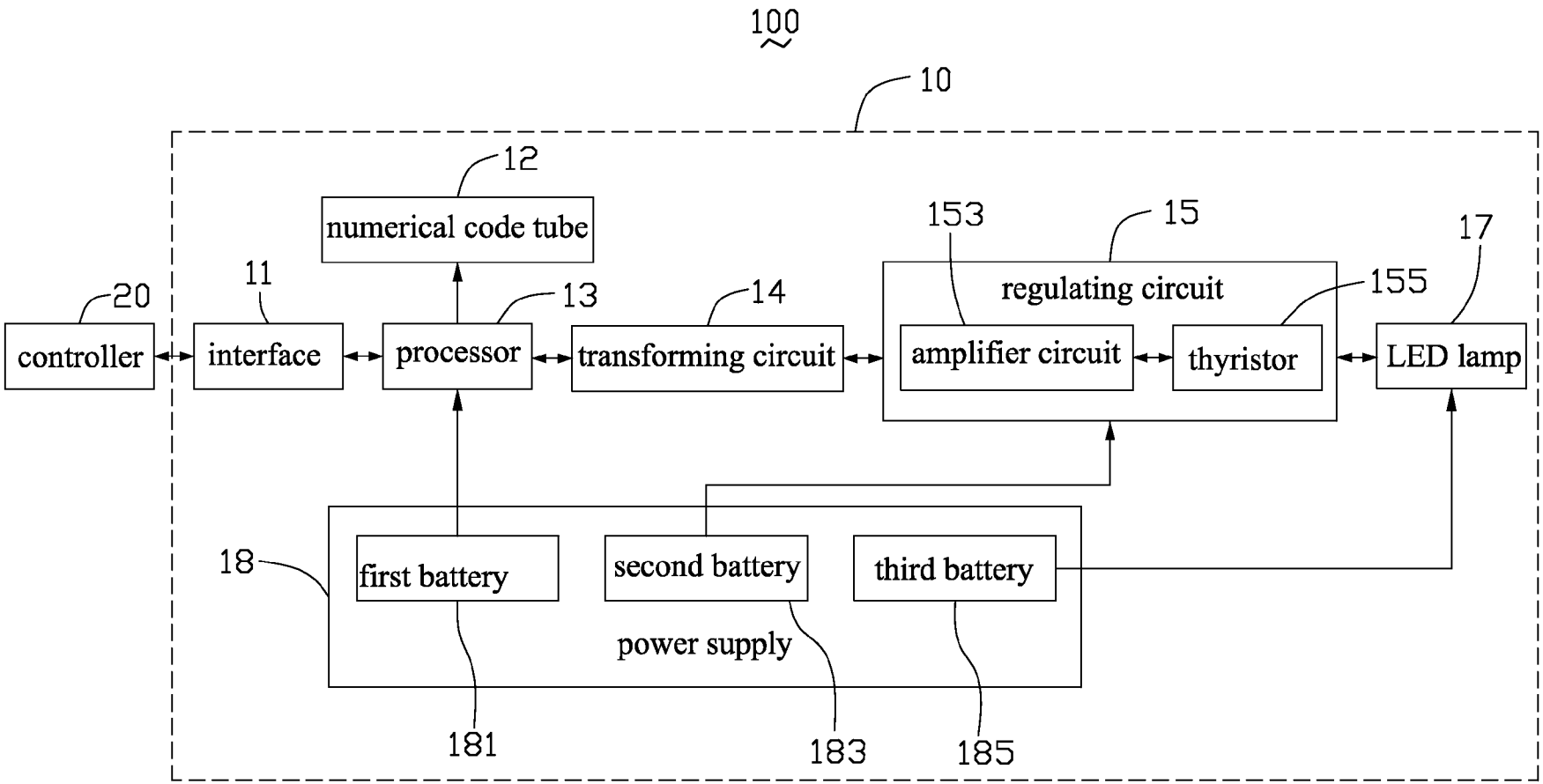
100
10
controller
20
interface
11
numerical code tube
12
processor
13
transforming circuit
14
amplifier circuit
153
regulating circuit
15
thyristor
155
LED lamp
17
first battery
181
second battery
183
third battery
185
power supply
18

LIGHT EMITTING DIODE ILLUMINATING APPARATUS WITH ADJUSTABLE LUMINANCE

BACKGROUND

1. Field of the Invention

The present invention relates to a light emitting diode (LED) illuminating apparatus, and particularly to an LED illuminating apparatus having controllable luminance.

2. Description of Related Art

Nowadays, light emitting diodes (LEDs) are widely used for illuminating apparatuses. In use, an LED illuminating apparatus generally needs precise luminance regulation, which is usually difficult to manually regulate.

Therefore, there is room for improvement within the art.

BRIEF DESCRIPTION OF THE DRAWINGS

Many aspects of the present LED illuminating apparatus can be better understood with references to the following drawings. The components in the various drawings are not necessarily drawn to scale, the emphasis instead being placed upon clearly illustrating the principles of the present LED illuminating apparatus. Moreover, in the drawings, like reference numerals designate corresponding parts throughout the figures.

The drawing is a diagram of an LED illuminating apparatus, according to an exemplary embodiment.

DETAILED DESCRIPTION OF THE EXEMPLARY EMBODIMENT

Referring to the drawing, a light emitting diode (LED) illuminating apparatus 100 according to an exemplary embodiment is provided. The LED illuminating apparatus 100 includes an illuminating member 10 and a controller 20 electrically connected to the illuminating member 10. The illuminating member 10 is an LED lamp assembly that can emit light at a predetermined luminance. The controller 20 is a conventional processor, such as a computer or a single chip. In use, the controller 20 can set a luminance of the illuminating member 10, express the luminance level as a numerical value, and display the numerical value to users.

The illuminating member 10 includes an interface 11, a numerical code tube 12, a processor 13, a transforming circuit 14, a regulating circuit 15, an LED lamp 17, and a power supply 18. The interface 11, the processor 13, the transforming circuit 14, the regulating circuit 15 and the LED lamp 17 are electrically connected in series according to the above sequence. The controller 20 is electrically connected to the interface 11. The numerical code tube 12 is electrically connected to the processor 13. The power supply 18 provides electrical power to the processor 13, the regulating circuit 15 and the LED lamp 17.

The interface 11 can be a USB interface or a universal asynchronous receiver/transmitter (UART) chip configured for connecting the illuminating member 10 to the controller 20. Thus, the controller 20 can send controlling signals to the illuminating member 10 through the interface 11. When the luminance level value of the illuminating member 10 is set in the controller 20, the luminance level value can be sent to the processor 13 by the interface 11.

The processor 13 can be a single chip configured for storing the luminance level value of the illuminating member 10 and sending the luminance level value as a digital signal to the transforming circuit 14. Furthermore, the processor 13 can also control the numerical code tube 12 to display the luminance level value. The transforming circuit 14 can transform the digital signal into an analog signal, subsequently sending the analog signal to the regulating circuit 15.

The regulating circuit 15 includes an amplifier circuit 153 and a thyristor 155 connected to the amplifier circuit 153. The amplifier circuit 153 can be an operation amplifier circuit. The analog signal sent to the regulating circuit 15 can be amplified by the amplifier circuit 153 and regulated by the thyristor 155, thereby creating an output current providing electric power to the LED lamp 17 in the regulating circuit 15 according to the analog signal.

The LED lamp 17 is formed by a plurality of LEDs (not shown), which emit light in a luminance according to the current input therein. The power supply 18 includes a first battery 181 having an electrical potential of approximately 5V, a second battery 182 having an electrical potential of approximately 9V, and a third battery 183 having an electrical potential of approximately 12V or 24V As such, the power supply 18 can provide different electrical potentials to the processor 13, the regulating circuit 15 and the LED lamp 17, respectively. A battery and an electric potential regulator can also form the power supply 18, thereby providing different electrical potentials.

When the LED illuminating apparatus 100 is used, the LED lamp 17 is electrically connected to the thyristor 155. The power supply 18 is turned on, and as a result, the first battery 181, the second battery 182 and the third battery 183 provide predetermined electrical potentials to the processor 13, the regulating circuit 15 and the LED lamp 17, respectively. A predetermined luminance of the illuminating member 10 is set by the controller 20. The controller 20 creates a luminance numerical value according to the predetermined luminance, and sends the numerical value to the processor 13 through the interface 11. The controller 20 can also display the numerical value.

The processor 13 stores the numerical value and sends the luminance level value as a digital signal to the transforming circuit 14. The single chip 13 can also control the numerical code tube 12 to display the luminance level value. The transforming circuit 14 transforms the digital signal into an analog signal, subsequently sending the analog signal to the regulating circuit 15. The analog signal is amplified by the amplifier circuit 153 and regulated by the thyristor 155, and as a result, an output current is created according to the analog signal. The output current is sent to the LED lamp 17, and the LED lamp 17 emits light having a luminance according to the luminance level value.

In use, even when the LED illuminating apparatus 100 is turned off, the luminance level value is stored in the processor 13 and/or the controller 20. When the LED illuminating apparatus 100 is used again, the regulating circuit 15 creates the output current according to the stored luminance level value, and then the predetermined luminance of the LED illuminating apparatus 100 does not need to be regulated again.

The aforementioned LED illuminating apparatus 100 has a simple structure, and it can automatically regulate its luminance precisely. The luminance of the LED illuminating apparatus 100 can also be manually regulated and stored through the controller 20.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A light emitting diode (LED) illuminating apparatus, comprising:

a controller configured for setting a predetermined luminance of the LED illuminating apparatus and creating a luminance level value according to the predetermined luminance; and an illuminating member including a processor, a transforming circuit, a regulating circuit, and an LED lamp connected in series, the processor being connected to the controller to store the luminance level value and send the luminance level value as a digital signal to the transforming circuit, the transforming circuit transforming the digital signal into an analog signal and sending the analog signal to the regulating circuit, the regulating circuit including an amplifier circuit and a thyristor connected to the amplifier circuit, the amplifier circuit amplifying the analog signal, the thyristor regulating the amplified analog signal and thereby creating an output current according to the analog signal, the output current sent to the LED lamp to provide electrical power to the LED lamp, such that the LED lamp emits light having the predetermined luminance.

2. The LED illuminating apparatus as claimed in claim 1, wherein the illuminating member includes a power supply connected to the processor, the regulating circuit and the LED lamp.

3. The LED illuminating apparatus as claimed in claim 1, wherein the controller displays the luminance level value.

4. The LED illuminating apparatus as claimed in claim 1, wherein the illuminating member includes an interface connecting the processor to the controller.

5. The LED illuminating apparatus as claimed in claim 1, wherein the illuminating member includes a numerical code tube connected to the processor to display the luminance level value.

6. The LED illuminating apparatus as claimed in claim 1, wherein the controller stores the luminance level value.

7. The LED illuminating apparatus as claimed in claim 2, wherein the power supply provided different electrical potentials to the processor, the regulating circuit and the LED lamp, respectively.

* * * * *